US006488229B2

(12) United States Patent
Denton

(10) Patent No.: US 6,488,229 B2
(45) Date of Patent: Dec. 3, 2002

(54) TOILET ROLL DISPENSER

(76) Inventor: Bradley T. Denton, 737 Ogden Rd. Unit B, New Lenox, IL (US) 60451

( * ) Notice: Subject to any disclaimer, the term of this patent is extended or adjusted under 35 U.S.C. 154(b) by 0 days.

(21) Appl. No.: 09/765,545

(22) Filed: Jan. 22, 2001

(65) Prior Publication Data

US 2002/0096595 A1 Jul. 25, 2002

(51) Int. Cl.[7] ..... B65H 67/00
(52) U.S. Cl. ..... 242/560.2; 242/598.2
(58) Field of Search ..... 242/560, 560.2, 242/594, 594.3, 594.4, 594.5, 598, 598.2, 598.3, 598.6, 599, 599.2; D6/523

(56) References Cited

U.S. PATENT DOCUMENTS 2,510,537 A * 6/1950 Agamaite, Jr. ..... 242/560.2
2,619,297 A * 11/1952 Sharrer ..... 242/560.2
3,010,670 A * 11/1961 Jones et al. ..... 242/560
4,344,583 A * 8/1982 Drum ..... 242/598.3
4,407,459 A * 10/1983 Wormly ..... 242/560.2
4,836,462 A * 6/1989 Bruss ..... 242/560
4,879,150 A * 11/1989 Schutz et al. ..... 242/560
6,199,791 B1 * 3/2001 Conran et al. ..... 242/560.2

* cited by examiner

*Primary Examiner*—William A. Rivera
(74) *Attorney, Agent, or Firm*—Ernest Kettelson

(57) ABSTRACT

A toilet roll dispenser primarily for use in portable toilets, comprising a housing having a first toilet paper roll supported on a mandrel in position for use, and a second or reserve toilet paper roll on the mandrel in side-by-side relationship. The reserve roll is received in the cavity of a use-prevention receptacle which is also supported on the mandrel in co-axial relationship with the reserve toilet paper roll. The side walls of the housing restrict lateral movement of the toilet paper rolls so the reserve toilet paper roll cannot be moved laterally out of the use-prevention receptacle until the first toilet paper roll has been used up and its paper core removed from the mandrel. While the reserve roll is in the cavity of the use-prevention receptacle it cannot be used. After the first roll has been completely used up, it is then possible to reach the paper core of the used up first roll and tear it away from the mandrel. The way is then clear to move the reserve toilet paper roll from the use-prevention receptacle whereupon it can then be used.

13 Claims, 8 Drawing Sheets

TOILET ROLL DISPENSER

FIELD OF THE INVENTION

This invention relates to the field of toilet paper dispensers in which at least two rolls of toilet paper are supported on a single mandrel or rod, and a use-prevention device to prevent use of the second roll until the first one has been used up. The invention is particularly adapted for use in portable toilets.

BACKGROUND OF THE INVENTION

A number of prior art devices have attempted to solve the problem of keeping people from using the second roll until the first has been completely used up. However, most of them are relatively complicated, difficult to use and expensive. Those known to the inventor are disclosed in the following United States Patents which are readily available for examination to the general public and others having an interest therein:

U.S. Pat. No. 3,656,699
U.S. Pat. No. 4,836,462
U.S. Pat. No. 4,765,475
U.S. Pat. No. 4,407,459
U.S. Pat. No. 3,790,097
U.S. Pat. No. 3,586,252
U.S. Pat. No. 3,584,802
U.S. Pat. No. 3,295,900
U.S. Pat. No. 2,619,297

SUMMARY OF THE INVENTION

This invention of a toilet paper dispenser having at least two rolls of toilet paper and a use-prevention receptacle to prevent use of the second roll until the first has been used up is particularly adapted for portable toilets. However, it can be adapted for use in other toilets as well.

The invention comprises a housing having a lateral dimension large enough to hold at least two rolls of toilet paper on a single laterally extending rod or mandrel supported in the housing by receiving apertures in the side walls of the housing to receive the opposite ends of the mandrel therethrough. A use-prevention receptacle is provided to receive one of the rolls of toilet paper in its cavity thereby preventing the paper from being unrolled until the roll can be removed from the use-prevention receptacle. It can't be removed until the other roll which is in abutting side-by-side relationship thereto has been used up and its paper core removed from the mandrel. When that is done, the roll in the use-prevention receptacle can be pulled out from the open wall thereof for use.

The use-prevention receptacle comprises a cylindrical cup like receptacle, having a solid cylindrical wall, a solid rear wall having a central aperture to receive the mandrel or rod therethrough and an oppositely facing open wall facing toward the toilet paper roll which is positioned for use on the mandrel. The extra roll is received in the use-prevention receptacle until the first roll has been completely used up and its paper core removed from the mandrel.

The use-prevention receptacle may be made of a relatively rigid plastic material. The configuration and dimension of its cavity corresponds with that of a roll of toilet paper whereby the roll can be received completely therein. It is also within the scope of this invention to provide a use-prevention receptacle having a cavity whose lateral depth is less than the corresponding lateral dimension of a roll of toilet paper, whereby the roll of toilet paper protrudes outwardly a certain distance from the cavity of the use-prevention receptacle but not so far as to permit someone to begin unrolling paper from such roll.

The cross-section or diameter of the cavity of the use-prevention receptacle corresponds to the diameter of a full roll of toilet paper whereby the roll of toilet paper is held firmly and snugly therein. Projections may be provided that extend outwardly from the cylindrical wall of the use-prevntion receptacle which a user can hold with one hand while using the other hand to withdraw the roll of toilet paper from the use-prevention receptacle after the first roll has been used up and its paper core removed from the mandrel.

One end of the mandrel which extends through the aperture in one of the side walls of the housing includes an aperture at its outer end to receive the shackle of a padlock that prevents removal of the mandrel from the housing until the padlock is removed. The opposite end of the mandrel or rod includes either an enlarged head having a diameter greater than that of the receiving aperture, or a projecting arm that extends radially outward from the axis of the mandrel or rod a sufficient distance to prevent drawing through the receiving aperture.

DESCRIPTION OF PREFERRED EMBODIMENT

Figure 1:
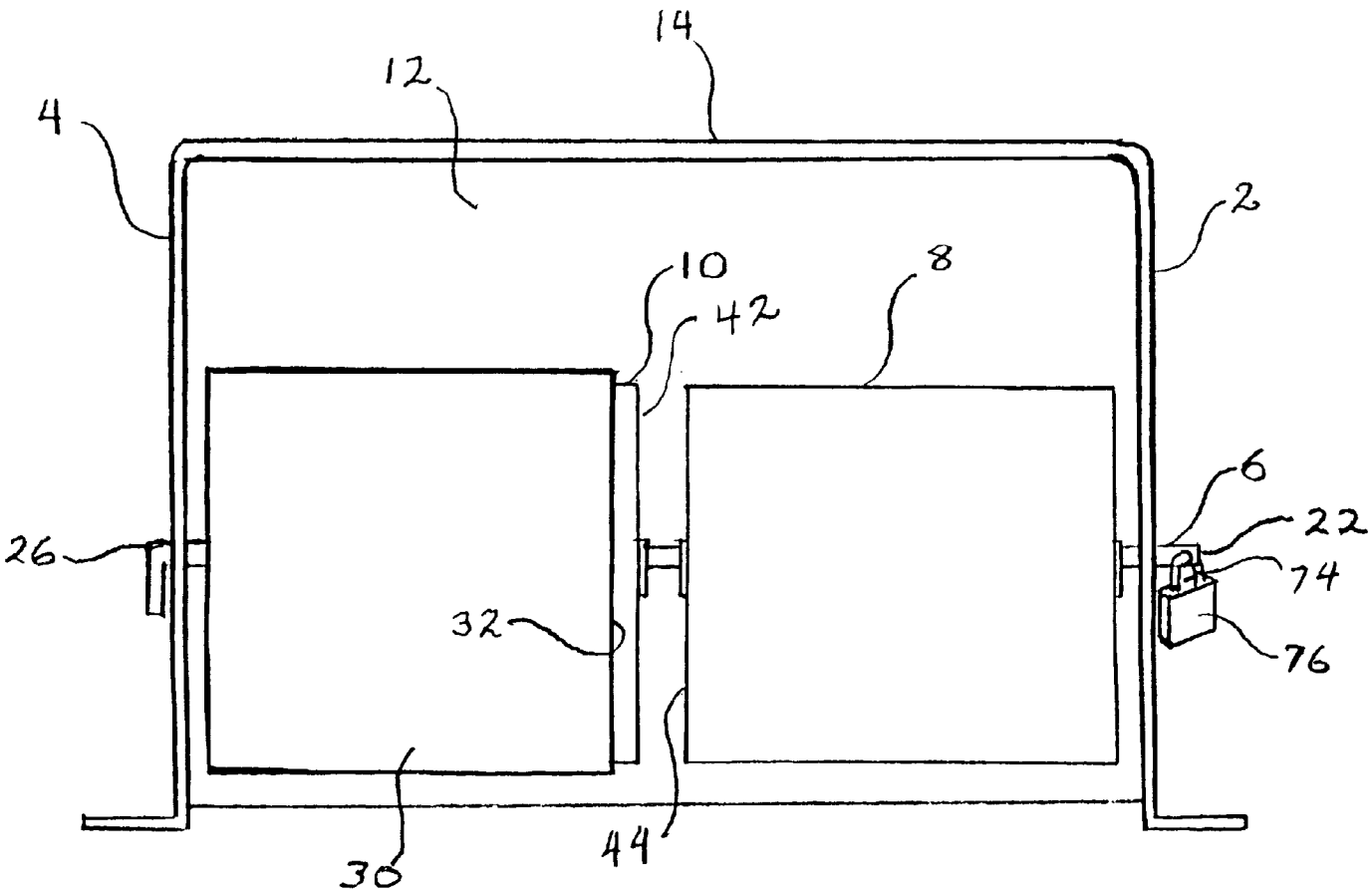
FIG. 1 is an elevation view of a toilet paper dispenser as described more fully herein below, showing two toilet paper rolls in side-by-side relationship within a housing, one roll being received in the cavity of a use-prevention receptacle in accordance with this invention, the other in position for use.
Figure 2:
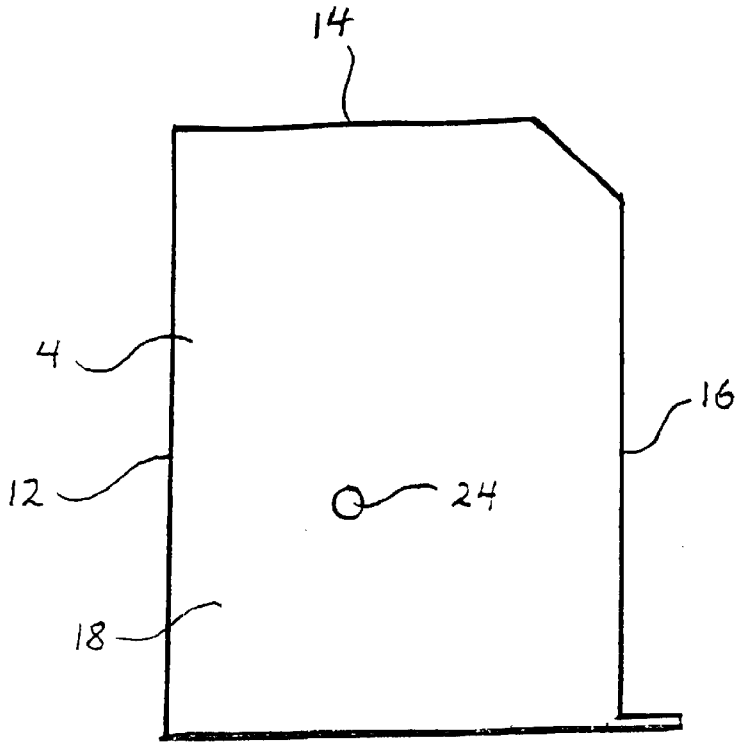
FIG. 2 is an elevation view of one of the side walls of the housing seen in FIG. 1.
Figure 3:
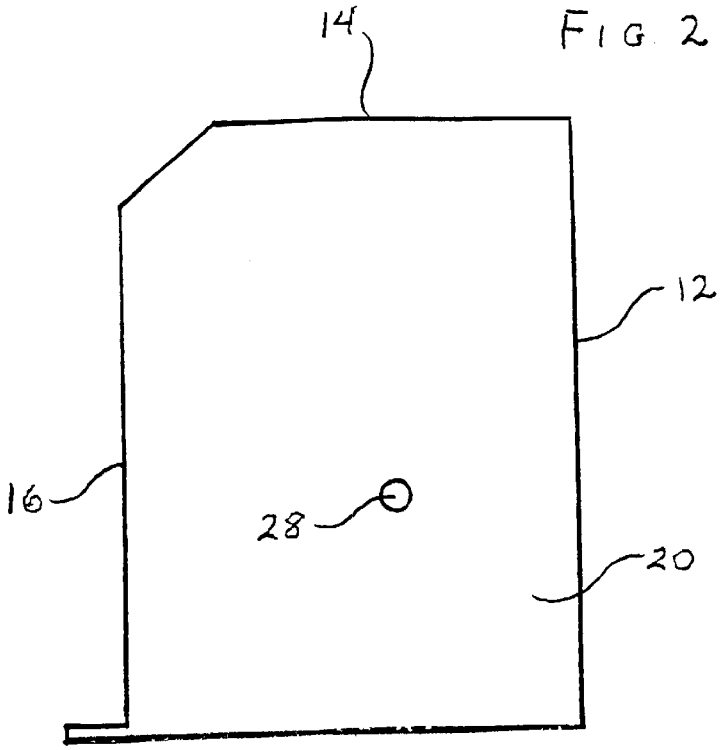
FIG. 3 is an elevation view of the opposite side wall of the housing.
Figure 4:
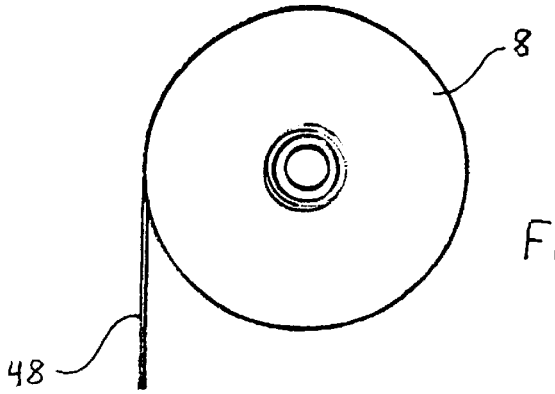
FIG. 4 is an end elevation view of a toilet paper roll.
Figure 5:
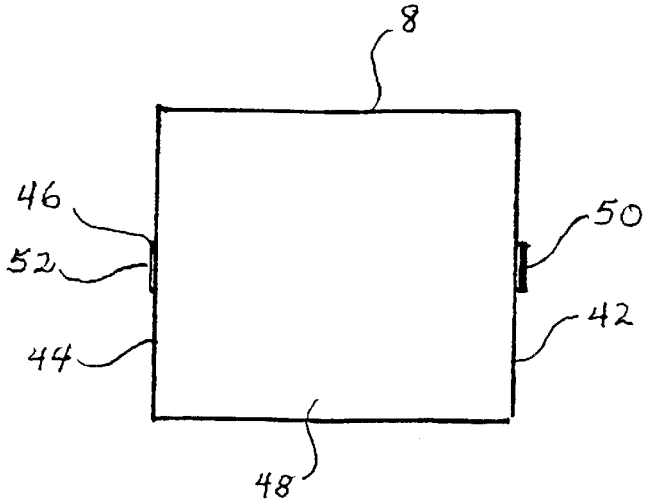
FIG. 5 is a side elevation view of the toilet paper roll seen in FIG. 4.
Figure 6:
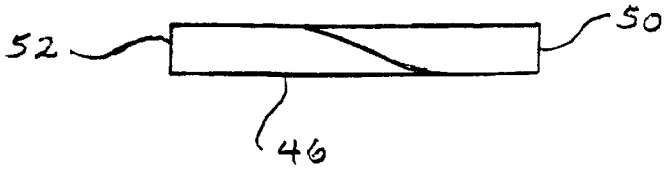
FIG. 6 is a side elevation view of the paper core of a toilet paper roll.
Figure 7:
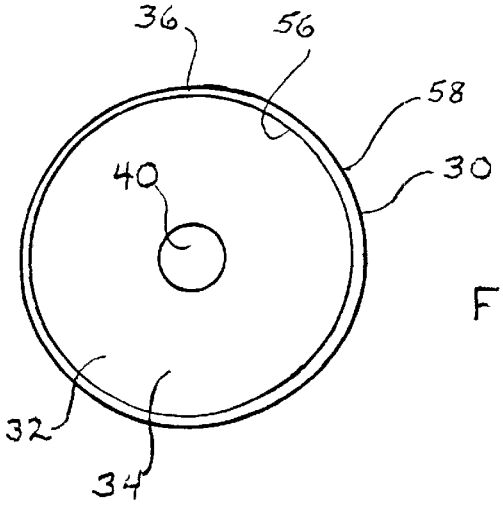
FIG. 7 is an end elevation view of the use-prevention receptacle in accordance with this invention looking toward its open end wall.
Figure 8:
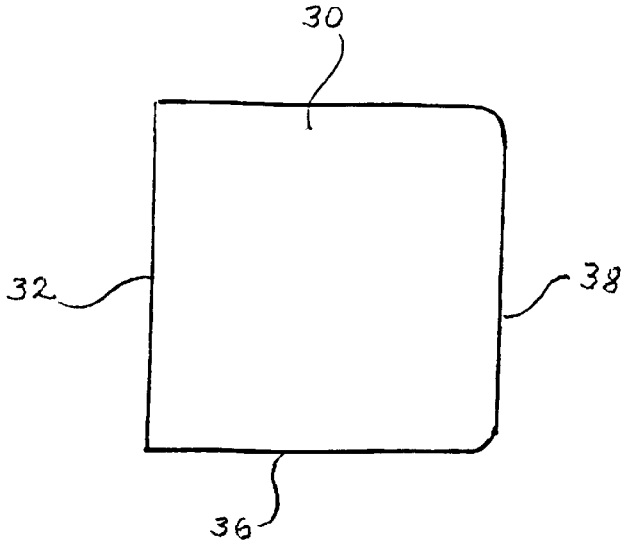
FIG. 8 is a side elevation view of the use-prevention receptacle seen in FIG. 7.
Figure 9:
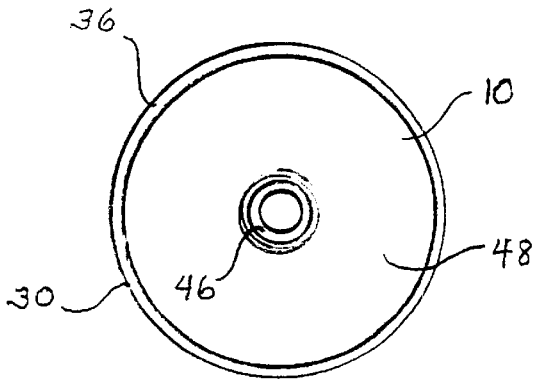
FIG. 9 is an end elevation view of the use-prevention receptacle seen in FIG. 7 with a toilet paper roll received in the cavity thereof.
Figure 10:
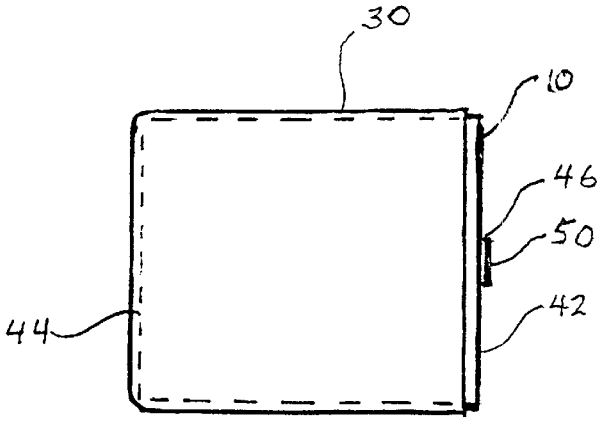
FIG. 10 is a side elevation view of the use-prevention receptacle and toilet paper roll therein as seen in FIG. 9, with the portions of the toilet paper roll received in the cavity of the use-prevention receptacle shown in broken lines.
Figure 11:
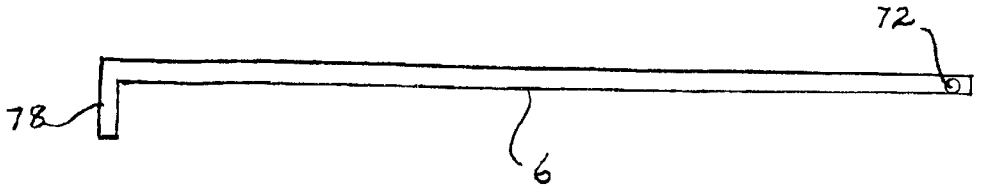
FIG. 11 is an elevation view of the rod or mandrel on which the toilet paper rolls are supported within the housing.
Figure 12:
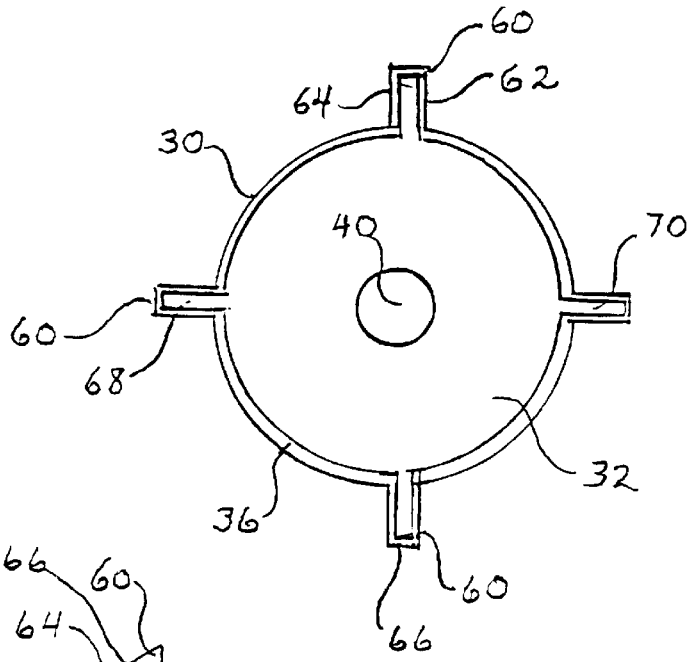
FIG. 12 is an end elevation view of a modified use-prevntion receptacle in accordance with this invention having circumferentially spaced apart projections extending outwardly from the cylindrical wall of the receptacle, looking toward its open end wall.
Figure 13:
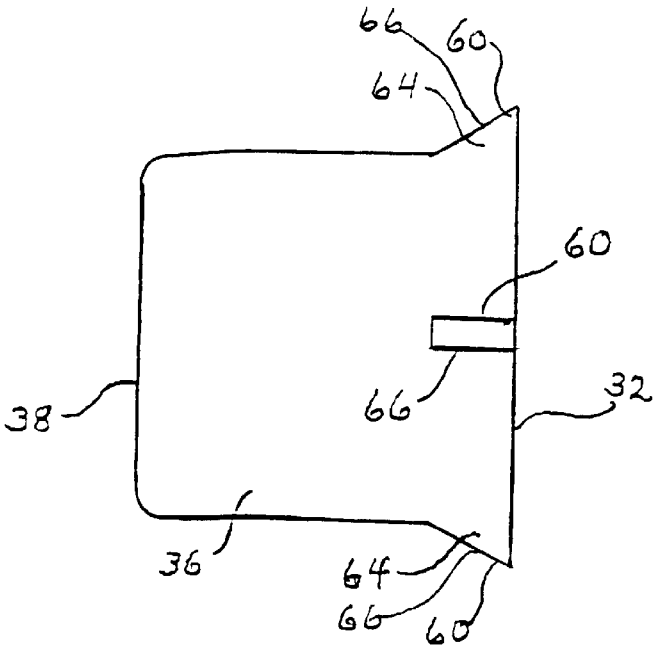
FIG. 13 is a side elevation view of the use-prevention receptacle seen in FIG. 12.
Figure 14:
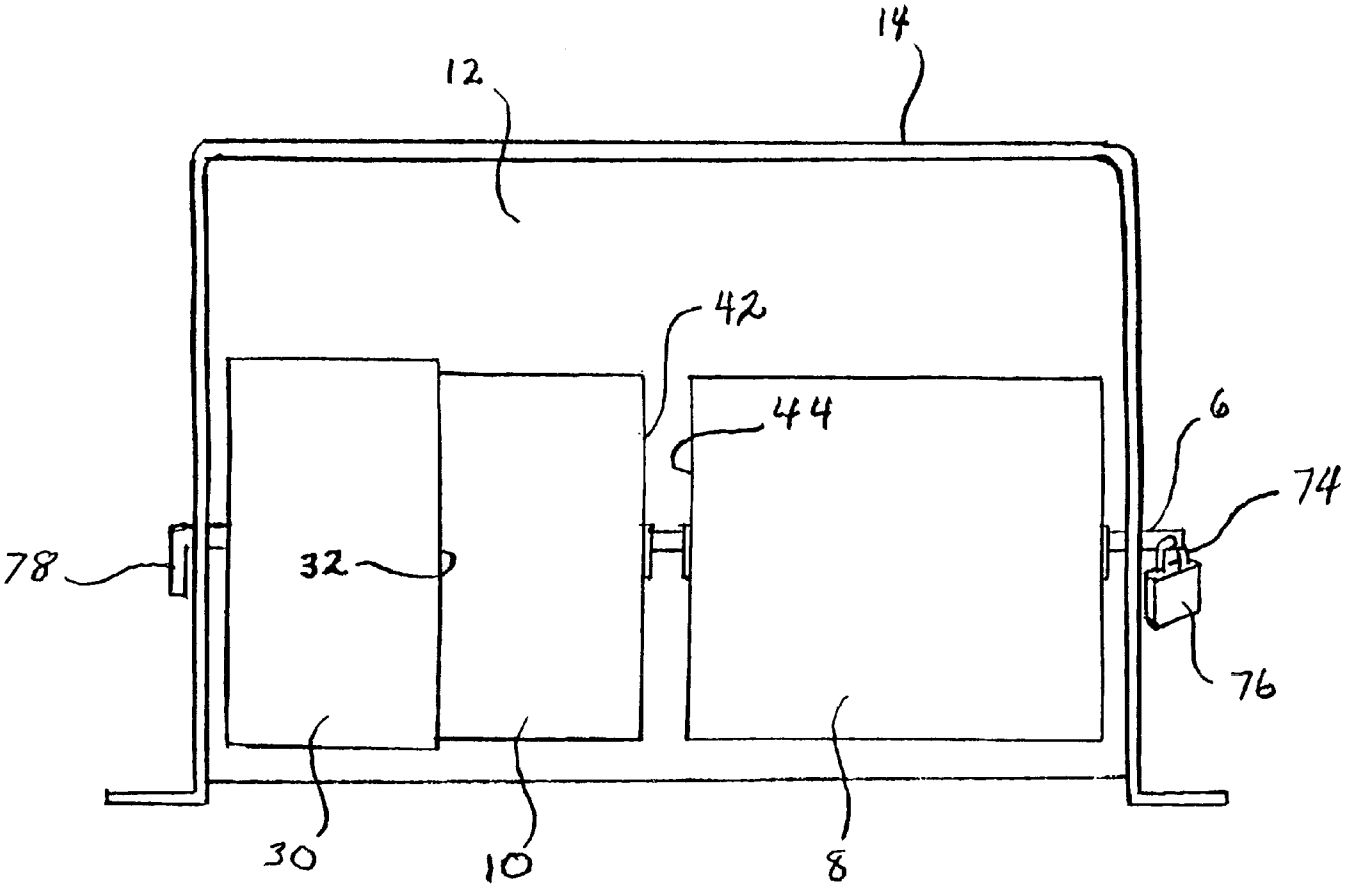
FIG. 14 is an elevation view of a toilet paper dispenser substantially as seen in FIG. 1, but wherein the use-prevention receptacle in accordance with this invention has a lateral dimension less than the corresponding lateral dimension of the toilet paper roll received therein, namely substantially about half the lateral dimension of the toilet paper roll.
Figure 15:
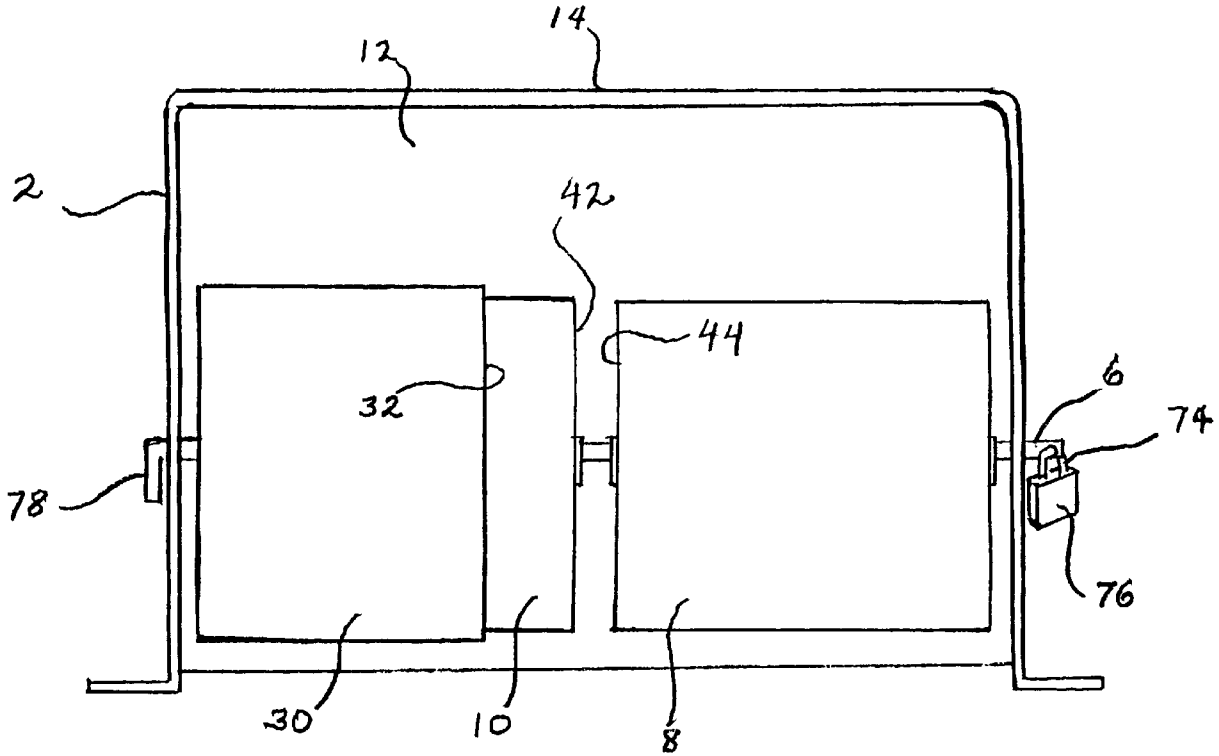
FIG. 15 is an elevation view of a toilet paper dispenser substantially as seen in FIG. 1 and FIG. 14, but wherein the use-prevention receptacle in accordance with this invention is shown with a lateral dimension relative to that of the toilet paper roll received therein which is between that of the use-receptacle seen in FIG. 1 and of the one seen in FIG. 14.

A toilet roll dispenser 2 in accordance with this invention comprises a housing 4, a mandrel 6 supported in the housing 4 to extend horizontally therein, wide enough to at least two toilet paper rolls 8 and 10 thereon. The housing 4 has an open front wall 12, a solid top wall 14, a solid rear wall 16, a first side wall 18 and an opposite second side wall 20. One end 22 of the mandrel 6 is rotatably received through aperture 24 in side wall 18 of the housing 4. The opposite end 26 of the mandrel 6 is received through aperture 28 in side wall 20 of the housing 4.

A cylindrical use-prevention receptacle 30 in accordance with this invention is slidingly mounted on the mandrel 6 within the housing 4, having a laterally facing open end wall 32 to receive a roll of toilet paper, such as toilet paper roll 10, in the cylindrical cavity 34 thereof. The use-prevention receptacle 30 includes a solid cylindrical wall 36 and a solid end wall 38 opposite from the open end wall 32. The solid end wall 38 includes a central aperture 40 to receive the mandrel 6 therethrough. The cylindrical wall 36 of the use-prevention receptacle 30 has a laterally extending dimension between the open end wall 32 thereof and the solid end wall 38 thereof that corresponds to the dimension of a roll of toilet paper, such as toilet paper rolls 8 and 10, between their respective first end walls 42 and their respective second and opposite end walls 44.

The laterally extending dimension of the solid cylindrical wall 36 of the use-prevention receptacle 30 may be less than the dimension between the first end wall 42 and second end wall 44 of a roll of toilet paper. Such dimension of the solid cylindrical wall 36 may for example be one-half the dimension between the first end wall 42 and second end wall 44 of a roll of toilet paper, or any dimension between said one-half and the full dimension of a roll of toilet paper between its first end wall 42 and its second end wall 44.

The toilet paper rolls 8 and 10 each include a central paper core 46 around which the paper 48 has been rolled. Each core 46 has substantially the same laterally extending dimension between its first end 50 and its opposite second end 52 as the dimension of the toilet paper rolls 8 and 10 between their respective first end walls 42 and their respective second end walls 44.

The side wall 18 of the housing 4 is spaced apart laterally from the opposite side wall 20 of the housing 4 a distance at least equal to twice the lateral dimension of a roll of toilet paper, such as toilet paper rolls 8 and 10, between its first end wall 42 and its second end wall 44, or twice the dimension between the first end 50 and second end 52 of a paper core 46. The side wall 18 of the housing 4 may be spaced apart from its opposite side wall 20 a distance that is greater than twice the said lateral dimension of a roll of toilet paper. In one embodiment of this invention, the side wall 18 of the housing 4 may be spaced apart from its opposite side wall 20 a distance that is twice the said lateral dimension of a roll of toilet paper plus an additional distance no greater than one-half the said lateral dimension of a roll of toilet paper.

The side walls 18 and 20 of the housing 4 limit the lateral movement of the toilet paper rolls 8 and 10 on the mandrel 6, and their respective paper cores 46, including the distance toilet paper roll 8 and its paper core 46 may be moved apart laterally from toilet paper roll 10 and its paper core 46.

Use of the invention is described as follows. Toilet paper roll 8 is positioned on the mandrel 6 outside of the use-prevention receptacle 30 where it is available for its intended purpose. Toilet paper roll 10 is positioned on the mandrel 6 next to toilet paper roll 8 in side-by-side relationship, but toilet paper roll 10 is received in the cylindrical cavity 34 of the use-prevention receptacle 30 with the side wall 42 of toilet paper roll 10 and open end wall 32 of the use-prevention receptacle 30 facing in the direction toward side wall 44 of toilet paper roll 8.

Toilet paper cannot be unrolled from toilet paper roll 10 while it is received in the cavity 34 of the use-prevntion receptacle 30. The only toilet paper that can be unrolled is from toilet paper roll 8 which is not received in the use-prevention receptacle 30. When all of the toilet paper has been unrolled from toilet paper roll 8, its paper core 46 may then be accessed and torn away from the mandrel 6. Until it is torn away, such paper core 46 will abut against the corresponding paper core 46 of toilet paper roll 10 thereby preventing enough lateral movement of toilet paper roll 10 on the mandrel 6 to move out of the cavity 34 of the use-prevention receptacle 30. When such exposed paper core 46 of the now used-up toilet paper roll 8 has been torn away, the toilet paper roll 10 may then be moved laterally along the mandrel 6 a sufficient distance to completely exit from the cavity 34 of the use-prevention receptacle. Toilet paper roll 10 is thereafter available for use, but only after all of the toilet paper of toilet paper roll 8 has been completely used.

The cylindrical wall 36 of the use-prevention receptacle 30 may have a completely smooth inner surface 56 and a completely smooth outer surface 58. In one embodiment of this invention, four circumferentially spaced apart projections 60 may be formed to extend radially outward from the outer surface 58 of the cylindrical wall 36, adjacent the open end wall 32 of the use-prevention receptacle. Such projections 60 enable a user to press thereagainst with one hand to hold the use-prevention receptacle 30 from lateral movement while grasping the facing portion of the roll of toilet paper in the receptacle 30 with the other hand to pull it laterally out of the cavity 34 of the use-prevention receptacle.

The projections 60 each have spaced apart triangular side walls 62 and 64 which are solid, and a diagonally extending upper wall 66 which is also solid tapering inwardly to the cylindrical side wall 36 as it extends rearwardly toward the opposite solid end wall 38 of the use-prevention receptacle 30. The projections 60 each include an open end wall 68 extending upwardly from the open end wall 32 of the use-prevention receptacle 30. The projections 60 each include a cavity 70 between the triangular side walls 62 and 64, and under the diagonally extending upper wall 66 of each projection 60.

One end of the mandrel 6 which extends through the aperture in one of the side walls of the housing 4 includes an aperture 72 at its outer end to receive the shackle 74 of a padlock 76 that prevents removal of the mandrel from the housing until the padlock is removed. The opposite end of the mandrel or rod includes either an enlarged head having a diameter greater than that of the receiving aperture, or a projecting arm 78 that extends radially outward from the axis of the mandrel or rod 6 a sufficient distance to prevent drawing through the receiving aperture.

I claim:

1. A toilet paper dispenser comprising a laterally extending support member having a lateral dimension sufficient to hold at least two toilet paper rolls for rotation thereon in side-by-side relationship, a first toilet paper roll mounted for rotation on said laterally extending support member in a position for use, a second toilet paper roll mounted for rotation on said laterally extending support member in side-by-side relationship with said first toilet paper roll, use-prevention means having a receiving cavity to receive said second toilet paper roll and thereby prevent unrolling paper from said second toilet paper roll until said second toilet paper roll can be moved from said receiving cavity to a position for use, and lateral movement restraining members to hold said first toilet paper roll while on said laterally extending support member close enough to said second toilet paper roll to prevent said second toilet paper roll from being moved from said receiving cavity of said use-prevention means to a said position for use of said second toilet paper roll, wherein said use-prevention means includes a use-prevention receptacle, said use-prevention receptacle includes a cylindrical wall surrounding said receiving cavity, said cylindrical wall extends laterally from a first cylindrical wall end facing toward said first toilet paper roll to a second cylindrical wall end facing away from said first toilet paper roll, the distance between said first cylindrical wall end and said second cylindrical wall end comprising a lateral cylindrical wall dimension of said use-prevntion receptacle, said use-prevention receptacle includes a solid end wall at said second cylindrical wall end, a central aperture in said solid end wall to receive said laterally extending support member therethrough, said use-prevention receptacle includes an open end wall at said first cylindrical wall end thereof, said open end wall facing toward said first toilet paper roll, wherein said receiving cavity of said use-prevention receptacle has a cross-section dimension and configuration corresponding to that of said second toilet paper roll for a snug fit of said second toilet paper roll in said receiving cavity, wherein said cylindrical wall of said use-prevention receptacle has a smooth inner surface, and an outer surface having at least one projecting member extending radially outward therefrom for a user to hold with one hand while withdrawing said second toilet paper roll from said receiving cavity with the other hand.

2. A toilet paper dispenser as set forth in claim 1, wherein said lateral movement restraining members include a first side wall positioned adjacent and outwardly from said first toilet paper roll, a second side wall positioned outwardly from said second toilet paper roll in said receiving cavity of said use-prevention means at a location which prevents lateral movement of said second toilet paper roll in said receiving cavity beyond the point at which said second toilet paper roll is spaced far enough from said first toilet paper roll to permit movement of said second toilet paper roll from said receiving cavity of said use-prevntion means to a position for use.

3. A toilet paper dispenser as set forth in claim 1, wherein said lateral movement restraining members include a housing, said housing including said first and second side walls, said housing including a housing cavity, said laterally extending support member, said first toilet paper roll thereon and said second toilet paper roll thereon being received in said housing cavity, said housing having an open wall opening to said housing cavity for access to said first and second toilet paper rolls.

4. A toilet paper dispenser as set forth in claim 1, wherein said laterally extending support member comprises a rod member.

5. A toilet paper dispenser as set forth in claim 1, wherein said first side wall includes a first side wall aperture therethrough, said rod extends through said first side wall aperture and terminates outwardly of said first side wall in a first end, a restraining member passageway through said rod adjacent said first end thereof substantially normal to the longitudinal axis of said rod to receive a removable restraining member therethrough to prevent lateral movement of said first end of said rod through said first side wall aperture.

6. A toilet paper dispenser as set forth in claim 1, wherein said removable restraining member comprises a padlock.

7. A toilet paper dispenser as set forth in claim 1, wherein said second side wall includes a second side wall aperture therethrough, said rod extends through said second side wall aperture and terminates outwardly of said second side wall in a second end, said second end of said rod includes a radial projection outwardly from the longitudinal axis of said rod a sufficient distance to prevent movement of said second end of said rod through said second side wall aperture.

8. A toilet paper dispenser as set forth in claim 1, wherein said second toilet paper roll has a first side, a laterally spaced apart opposite second side, the distance between said first and second ends of said second toilet paper roll comprising a lateral toilet paper roll dimension.

9. A toilet paper dispenser as set forth in claim 1, wherein said lateral cylindrical wall dimension of said use-prevntion receptacle is substantially the same as the said lateral toilet paper roll dimension of said second toilet paper roll.

10. A toilet paper dispenser as set forth in claim 1, wherein said lateral cylindrical wall dimension of said use-prevntion receptacle is less than the said lateral toilet paper roll dimension of said second toilet paper roll.

11. A toilet paper dispenser as set forth in claim 1, wherein said lateral cylindrical wall dimension of said use-prevntion receptacle is substantially one-half the said lateral toilet paper roll dimension of said second toilet paper roll.

12. A toilet paper dispenser as set forth in claim 1, wherein said lateral cylindrical wall dimension of said use-prevntion receptacle is any dimension between one-half the said lateral toilet paper roll dimension of said second toilet paper roll and the same as said lateral toilet paper roll dimension.

13. A toilet paper dispenser comprising a laterally extending support member having a lateral dimension sufficient to hold at least two toilet paper rolls for rotation thereon in side-by-side relationship, a first toilet paper roll mounted for rotation on said laterally extending support member in a position for use, a second toilet paper roll mounted for rotation on said laterally extending support member in side-by-side relationship with said first toilet paper roll, use-prevention means having a receiving cavity to receive said second toilet paper roll and thereby prevent unrolling paper from said second toilet paper roll until said second toilet paper roll can be moved from said receiving cavity to a position for use, and lateral movement restraining members to hold said first toilet paper roll while on said laterally extending support member close enough to said second toilet paper roll to prevent said second toilet paper roll from being moved from said receiving cavity of said use-prevention means to a said position for use of said second toilet paper roll, wherein said use-prevention means includes a use-prevention receptacle, said use-prevention receptacle includes a cylindrical wall surrounding said receiving cavity, said cylindrical wall extends laterally from a first cylindrical wall end facing toward said first toilet paper roll to a second cylindrical wall end facing away from said first toilet paper roll, the distance between said first cylindrical wall end and said second cylindrical wall end comprising a lateral cylindrical wall dimension of said use-prevntion receptacle, said use-prevention receptacle includes a solid end wall at said second cylindrical wall end, a central aperture in said solid end wall to receive said laterally extending support member therethrough, said use-prevention receptacle includes an open end wall at said first cylindrical wall end thereof, said open end wall facing toward said first toilet paper roll, wherein said receiving cavity of said use-prevention receptacle has a cross-section dimension and configuration corresponding to that of said second toilet paper roll for a snug fit of said second toilet paper roll in said receiving cavity, wherein said cylindrical wall of said use-prevention receptacle has a smooth inner surface, and an outer surface having at least one projecting member extending radially outward therefrom for a user to hold with one hand while withdrawing said second toilet paper roll from said receiving cavity with the other hand, wherein said projecting member comprises a first triangular side wall, a closely spaced apart second triangular side wall, an open projecting member wall facing toward said first toilet paper roll, co-planar with said open wall of said use-prevention receptacle which opens to said receiving cavity, and extending radially outward therefrom, said projecting member including a diagonally extending top wall tapering from the upper end of said open projecting member wall to intersect with and terminate at said cylindrical wall of said use-prevention receptacle, and a projecting member cavity between said spaced apart first and second triangular side walls of said projecting member.

* * * * *